United States Patent [19]

Rey

[11] Patent Number: 4,536,186

[45] Date of Patent: Aug. 20, 1985

[54] USE OF POLY (DMDAAC) AS COAL FINE SLURRY VISCOSITY REDUCER

[75] Inventor: Paul A. Rey, Coraopolis, Pa.

[73] Assignee: Calgon Corporation, Pittsburgh, Pa.

[21] Appl. No.: 606,046

[22] Filed: May 2, 1984

[51] Int. Cl.[3] ..... C10L 1/32

[52] U.S. Cl. ..... 44/51; 406/47; 406/49

[58] Field of Search ..... 44/51; 406/47, 49

[56] References Cited

U.S. PATENT DOCUMENTS

| | | | |
|---|---|---|---|
| 4,141,691 | 2/1979 | Antonetti et al. | 44/1 R |
| 4,225,445 | 9/1980 | Dixon | 252/8.55 |
| 4,242,098 | 12/1980 | Braun et al. | 44/51 |
| 4,330,301 | 5/1982 | Yamamura et al. | 44/51 |
| 4,415,338 | 11/1983 | Schick et al. | 44/51 |

*Primary Examiner*—Y. Harris Smith

*Attorney, Agent, or Firm*—Michael C. Sudol; R. Brent Olson; William C. Mitchell

[57] ABSTRACT

The instant invention is directed to a method of reducing the viscosity of an aqueous coal fine slurry which comprises adding poly (dimethyl diallyl ammonium chloride) to the slurry.

2 Claims, No Drawings

USE OF POLY (DMDAAC) AS COAL FINE SLURRY VISCOSITY REDUCER

BACKGROUND OF THE INVENTION

It is necessary to reduce the viscosity of coal fine slurries in order to make it pumpable. The viscosity may be reduced by the addition of water. The addition of water, however, reduces the active concentration.

It is an object of the instant invention to produce a stable dispersion or suspension, reduce the viscosity and reduce friction.

DESCRIPTION OF THE INVENTION

The instant invention is directed to a method of reducing the viscosity of an aqueous coal fine slurry which comprises adding poly (dimethyl diallyl ammonium chloride) to the slurry.

Although the homopolymer of poly (dimethyl diallyl ammonium chloride), hereinafter "poly (DMDAAC)", is preferred, copolymers of poly (DMDAAC) may be used, in particular copolymers of acrylamide and DMDAAC.

The slurry is generally 40 to 60% solids, principally coal and 40 to 60% water. The coal fine slurry has already had clay and impurities substantially removed so that it is a clean coal aqueous slurry. Up to 10% clay and impurities may still be present. Any molecular weight poly (DMDAAC) may be used. It is preferred that the poly DMDAAC have an intrinsic viscosity of less than 3.0, preferably less than 2.0, most preferably less than 1.0 in 1.0M sodium chloride, measured on a 75 Cannon Ubbelohde capillary viscometer.

Although any dosage may be used, it is preferred to use 1 to 10 lbs of poly (DMDAAC) per ton of dry coal.

Less than 2 lb/ton is not usually sufficiently effective, above 10 lbs/ton is economically undesirable.

EXAMPLES

The slurry viscosity of a pulverized Pittsburgh seam coal, 60% solids, was determined on a Model β35 Fann viscometer at 600, 300, and 3 rpm. A blank sample with no polymer was compared against the poly (DMDAAC) containing slurry. The poly (DMDAAC) used has an intrinsic viscosity of 0.6 in 1.0M NaCl, measured on a 75 Cannon Ubbelohde capillary viscometer.

TABLE

| | | Slurry Viscosity (cps) | | | |
|---|---|---|---|---|---|
| Polymer | lb/ton | @ 600 RPM | @ 300 RPM | @ 3 RPM | COMMENTS |
| blank | — | 150 | 107 | 11 | — |
| poly DMDAAC | 1.1 | 120 | 97 | 9 | slightly flocculated |
| poly DMDAAC | 3.3 | 102 | 60 | 4 | thinning |
| poly DMDAAC | 11.1 | 88 | 47 | 1 | dispersed |

What is claimed is:

1. A method of reducing the viscosity of a 40%–60% coal fine/40–60% water slurry which comprises adding 1 to 10 lbs per ton of dry coal of poly(dimethyl diallyl ammonium chloride) to the slurry, wherein said coal fine slurry has been treated so as to substantially remove clay and impurities prior to addition of said poly(-dimethyl diallyl ammonium chloride).

2. The method of claim 1, wherein said poly (dimethyl diallyl ammonium chloride) has an intrinsic viscosity of less than 3.0.

* * * * *